US007581276B2

(12) United States Patent
Endo et al.

(10) Patent No.: US 7,581,276 B2
(45) Date of Patent: Sep. 1, 2009

(54) CLEANING PAD, LAMINATED BODY OF A CLEANING PAD AND CLEANING TOOL

(75) Inventors: Makoto Endo, Yokohama (JP); Ryuji Kawamoto, Odwara (JP)

(73) Assignee: Johnson Professional Co., Ltd., Yokohama-Shi (JP)

( * ) Notice: Subject to any disclaimer, the term of this patent is extended or adjusted under 35 U.S.C. 154(b) by 765 days.

(21) Appl. No.: 11/156,764

(22) Filed: Jun. 20, 2005

(65) Prior Publication Data

US 2005/0283931 A1 Dec. 29, 2005

(30) Foreign Application Priority Data

Jun. 23, 2004 (JP) ..... 2004-184991

(51) Int. Cl.
*A47K 11/10* (2006.01)

(52) U.S. Cl. ..... 15/210.1; 15/223; 15/228; 15/209.1

(58) Field of Classification Search ..... 15/104.93, 15/104.94, 210.1, 223, 209.1, 224, 228, 229.11, 15/229.13
See application file for complete search history.

(56) References Cited

U.S. PATENT DOCUMENTS 2,816,313 A * 12/1957 Gasper et al. ..... 15/210.1
6,485,822 B1 * 11/2002 Osiecki et al. ..... 428/316.6
7,316,046 B2 * 1/2008 Michaels et al. ..... 15/210.1

FOREIGN PATENT DOCUMENTS

JP 8215104 8/1996
JP 2000279344 10/2000
JP 2001046279 2/2001

* cited by examiner

*Primary Examiner*—Shay L Karls

(57) ABSTRACT

A cleaning pad is provided that is disposable into a toilet after cleaning. Also provided is a laminated body of cleaning pads, and a cleaning tool that holds the cleaning pad or the laminated body of cleaning pads. A cleaning pad is formed in such a manner that an intermediate layer containing water-degradable pulp is interposed between two layers of water-degradable nonwoven fabric or water-soluble pulp paper, and the cleaning pad comprises a cleaning composition. A laminated body of cleaning pads is provided by forming cleaning pads in layers, and a cleaning tool holds the cleaning pad or the laminated body of cleaning pads.

7 Claims, 5 Drawing Sheets

CLEANING PAD, LAMINATED BODY OF A CLEANING PAD AND CLEANING TOOL

CROSS-REFERENCE TO RELATED APPLICATION

This application claims the benefit of Japan Patent Application Number 2004-184991, filed on Jun. 23, 2004.

FIELD OF THE INVENTION

The present invention pertains to a type of cleaning pad, a type of laminated body of cleaning pads, and a type of cleaning tool. More specifically, the present invention pertains to a type of cleaning pad, a type of laminated body of cleaning pads, and a type of cleaning tool for cleaning toilets, etc.

BACKGROUND OF THE INVENTION

In the prior art, as a cleaning tool for cleaning dirt attached to the hard surface of toilets, etc., for example, a brush, sponge or other cleaning member is attached on the tip of a wood or plastic handle for use. However, for said cleaning tool, although it can perform cleaning without soiling the hands of the user, the dirt originally attached to the toilet is left on the brush or sponge after the cleaning operation. Usually, even when the dirt left on the brush, etc. after cleaning is exposed to water flow in the toilet, it remains stuck on the brush, etc. As a result, this leads to a major sanitation problem. Also, people are very reluctant to wash the dirt from the brush with their hands.

In consideration of the aforementioned problem, for example, Japanese Kokai Patent Application No. Hei 8[1996]-215104 disclosed a type of cleaning tool characterized by the fact that it is composed of a water degradable pad that can be dissolved slowly in water during cleaning, a holder for holding the pad, and a handle attached to the holder. Also, Japanese Kokai Patent Application No. 2001-46279 discloses a type of toilet brush characterized by the fact that instead of the scrubbing brush or sponge for the toilet in the prior art, a water-soluble dustcloth or the like for cleaning a toilet is formed in a roll shape on the tip portion, and, after cleaning, the dustcloth portion alone is removed and disposed in the toilet so that it can be flushed. In addition, Japanese Kokai Patent Application No. 2000-279344 discloses a type of cleaning tool characterized by the fact that the cleaning portion is composed of water degradable paper, the holding portion for holding the cleaning portion and the handle formed monolithically with the holding portion are formed with a resin or a thick paper, and the cleaning portion and the holding portion are set in a quick connect/disconnect way. However, although the cleaning tool can be disposed of in the toilet and flushed after cleaning, during the process of cleaning, the cleaning tool is still unsatisfactory with respect to its cleaning property, operability, and shape stability.

SUMMARY OF THE INVENTION

The objective of the present invention is to solve the aforementioned problems of the prior art by providing a type of cleaning pad, a laminated body of cleaning pads, and a type of cleaning tool holding said cleaning pad or laminated body of cleaning pads characterized by the fact that the pad(s) can be disposed of in a toilet or the like and flushed after cleaning, and the pad(s) has an excellent cleaning property, operability, and shape stability during the cleaning operation.

In order to solve the aforementioned problems, the present inventors have performed extensive research. As a result of this research, it was found that by containing a detergent composition in a cleaning pad with a prescribed structure, the aforementioned objective can be reached. As a result, the present invention was reached.

The present invention provides a type of cleaning pad, a type of laminated body of cleaning pads, and a type of cleaning tool holding said cleaning pad or laminated body of cleaning pads characterized by the fact that while the pad(s) can be disposed of in a toilet, etc. and flushed after cleaning, pad(s) has/have an excellent cleaning property, operability, and shape stability during the cleaning operation.

BRIEF DESCRIPTION OF THE FIGURES

FIG. 2(*b*) is a diagram illustrating another example of form of use of a cleaning pad of the present invention in a folded-back state.

DETAILED DESCRIPTION OF THE INVENTION

Cleaning Pad

Figure 1:
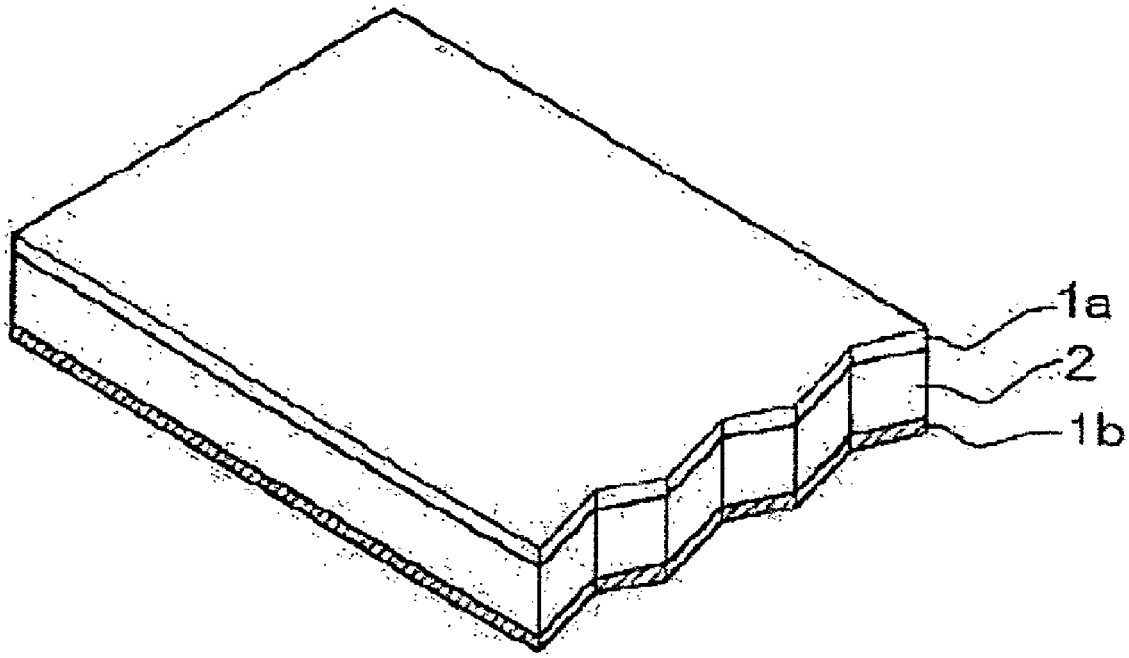
FIG. 1 is a diagram illustrating an embodiment of the cleaning pad of the present invention.

The present invention provides a type of cleaning pad characterized by the fact that the pad has an intermediate layer containing water degradable pulp and sandwiched between two layers made of water degradable nonwoven fabric or water-soluble pulp paper, and the pad contains a detergent composition.

The cleaning pad has a constitution in which an intermediate layer containing water degradable pulp is sandwiched between two layers made of water degradable nonwoven fabric or water-soluble pulp paper. As to be explained later in detail, even when water is contained, the shape of the pad still can be maintained with high stability within the time needed for cleaning. Consequently, the shape does not collapse during the cleaning process, the operability of the cleaning operation is excellent, and dirt sticking on the surface of a toilet or the like for cleaning can be effectively removed. Also, the cleaning pad of the present invention contains a detergent composition. In the cleaning process, when water is fed to the detergent composition, a liquid detergent composition flows out of the pad, so that the cleaning property is further improved. In addition, since the cleaning pad of the present invention is made of a water degradable or water-soluble feed material, it can be disposed of in a toilet or the like and flushed after use. Consequently, it can be used with excellent hygienic effect.

The cleaning pad of the present invention can be used in cleaning a toilet, bathroom kitchen, etc. Especially, it is appropriate for use in cleaning a toilet. Also, the cleaning pad of the present invention is made of a water degradable or water-soluble feed material. Consequently, when it is used in cleaning a toilet, it can be directly disposed of in the toilet and flushed.

For the cleaning pad of the present invention, because it should be disposed in a toilet, etc. and flushed after use, it should have a water-resolving property.

In this case, while the cleaning pad of the present invention (or the laminated body of cleaning pads of the present invention to be described later) should have a water-resolving property, it should have water-resolving property just like that required for tissue. As a result, it is believed that it will not clog a sewage pipeline when flushed. As far as the water-resolving property of tissue is concerned, a standard concerning its ease of unraveling exists in JIS P 4501 (1999 edition). The cleaning pad and laminated body of cleaning pads of the present invention have a shape significantly different from that of tissue. Consequently, said JIS standard cannot be adopted as is. If the following listed judgment standards are met, it can realize the unraveling (water-resolving property)

Index of judgment of water-resolving property (1) Evaluation Method:

a. 1,000 mL of tap water at 20° C. are loaded in a 2,000-mL measuring cylinder with a cock.
b. The sample (the cleaning pad or laminated body of cleaning pads in a state ready for use) is loaded in said measuring cylinder, and the cock is tightly closed.
c. The upper portion and bottom portion of the measuring cylinder containing sample are held with the two hands, respectively, and the cylinder is carefully inverted.
d. The measuring cylinder is slowly turned back to its normal posture. After setting still for 3 seconds, the state of the sample is observed.
e. Operations c and d are repeated, and the degree of resolving of the sample is observed.

(2) Evaluation

Evaluation is performed according to the following evaluation standard. The result is judged using the following grades.

Evaluation Grades

◎: The sample is resolved in 5 or less cycles of flipping the cylinder. Excellent water-resolving property.

○: The sample is resolved in 6-10 cycles of flipping of the cylinder. Good water-resolving property is displayed.

Δ: The sample is resolved in 11-15 cycles of flipping of the cylinder. It displays a water-resolving property, and the water degradable level is without problem in practical application.

X: The sample is resolved in more than 15 cycles of flipping of the cylinder.

Adjustment of the water-resolving property of the cleaning pad can be performed by means of adjustment of the combination of water degradable nonwoven fabric or water-soluble pulp paper, water-soluble pulp, and other feed materials, adjustment of the density and insertion rate, pad shape, size, thickness, etc.

FIG. 1 is a diagram illustrating an example of the embodiment of the cleaning pad of the present invention. In FIG. 1, (1*a*) and (1*b*) represent water degradable nonwoven fabric or water-soluble pulp paper, and (2) represents the intermediate layer containing water-soluble pulp.

In FIG. 1, the hatched portion (1*b*) indicates the state of containing a detergent composition (and abrasive) in the water degradable nonwoven fabric or water-soluble pulp paper as a preferable embodiment of the present invention. Naturally, the present invention is not limited to this scheme. The detergent composition (and abrasive) may also be contained in both (1*a*) and (1*b*), and in all of (1*a*), (1*b*), and (2). As far as the shape of the cleaning pad is concerned, one may adopt the rectangular parallelopiped shape shown in FIG. 1, or other shapes, such as a circular shape, elliptical shape, etc. Also, the tip of the pad may be formed in the sawtooth shape shown in FIG. 1. In the following, an explanation will be provided in detail for the various structural elements of the cleaning pad of the present invention.

Water Degradable Nonwoven fabric or Water-Soluble Pulp Paper/Water Degradable Nonwoven Fabric There is no special limitation on the type of water degradable nonwoven fabric, as long as the material is water degradable. For example, one may use spunless nonwoven fabric or the like mainly made of natural cellulose fibers.

Water-Soluble Pulp Paper

As a type of water-soluble pulp paper for use in the present invention, for example, one may use paper prepared from natural cellulose fibers, and wet paper, etc. may be used preferably.

For the cleaning pad of the present invention, the two outermost layers (outer layer or inner layer) that form the pad are made of said water degradable nonwoven fabric or water-soluble pulp paper. For the cleaning pad of the present invention, both the outer layer and inner layer can be made of water degradable nonwoven fabric or water-soluble pulp paper. Also, it is possible to use the water degradable nonwoven fabric as one layer, and the water-soluble pulp paper as the other layer. According to the present invention, it is preferred that both the outer layer and inner layer be made of the same raw material. Especially, it is preferred that both the outer layer and inner layer be made of water degradable nonwoven fabric.

Also, there is no special limitation on the thickness of the layer (one layer) made of the water degradable nonwoven fabric or water-soluble pulp paper. Usually, the thickness is in the range of 50-300 μm.

Intermediate Layer

According to the present invention, the intermediate layer contains water-soluble pulp. It is sandwiched between said two layers made of said water degradable nonwoven fabric or water-soluble pulp paper.

For the cleaning pad of the present invention, the intermediate layer contains water-soluble pulp. Consequently, the detergent composition contained in the cleaning pad functions as a liquid detergent when water is fed to it in the cleaning operation. In this case, the liquid detergent can be held in the cleaning pad, and the detergent effect can last.

As water-soluble pulp for application in the present invention, for example, one may preferably use the pulp of natural cellulose fibers, etc.

The thickness of the intermediated layer in the cleaning pad of the present invention can be selected appropriately. Usually, the thickness is in the range of 5-20 mm.

Detergent Composition

The cleaning pad of the present invention has a characteristic feature that it contains a detergent composition.

As the detergent composition of the present invention, an appropriate selection can be made corresponding to the cleaning object of the cleaning pad.

Examples of preferable detergent compositions for use in the present invention include detergent compositions containing surfactants (those mainly having a detergent effect), a foam adjusting agent, preservative, coloring agent (pigments, dyes), and other components. In addition to said components, as needed, the detergent composition may also contain a bleaching component, solvent, perfume, bactericide, bacteria removing agent, stain removing agent, deodorant, foaming agent, defoaming agent, chelating agent, pH adjusting agent, viscosity adjusting agent, oxidation inhibitor, UV absorbent, etc.

Examples of the aforementioned surfactants include anionic surfactants, nonionic surfactants, amphoteric surfactants, etc. Among them, especially, sulfate salts, sulfonate salts, and other anionic surfactants, as well as higher alcohol, alkyl ether, and other polyethylene glycol ether type nonionic surfactants are preferred.

As said foam adjusting agent, one may use a conventional foam adjusting agent appropriate for the detergent composition. Especially, an alkanolamide of a higher fatty acid is most preferred.

As said preservative, one may use a conventional preservative used in a detergent composition. Also, one may use a commercially available preservative, such as Kathon (product of Rohm & Haas Co.), Bidban (product of Dow Corp.), Denicide (product of Nagase Co., Ltd.), etc.

As far as said coloring agent (pigment, dye) is concerned, it is preferred that it be contained such that the user feels satisfied with respect to cleanness as a visual cleaning range that the user can understand. Examples of coloring agents (pigments, dyes) that may be used include direct dyes, acidic dyes, water-soluble organic pigments, etc. Among them, acidic dyes are preferred.

Among the other components that may be contained in the detergent composition, a bleaching component is preferred. Examples of bleaching components that can be used in the present invention include percarbonate salts, perborate salts, hydrogen peroxysulfate salts, perphosphate salts, persilicate salts, chlorinated isocyanurate compounds, sodium chloride hydrogen peroxide adduct, etc. The proportion of the bleaching component in the detergent composition with respect to the total solids content of the detergent composition is preferably in the range of 1-30 wt %.

In the following, preferable components and contents of the detergent compositions that can be used in the present invention are listed. Of course, the present invention is not limited to these examples.

EXAMPLE

Higher alcohol sodium sulfate ester: 5-20 wt %
Sodium alkyl benzene sulfonate: 2-20 wt %
Alkanolamide coconut oil fatty acid: 3-20 wt %
Preservative (Kation, product of Rohm & Haas Corp.): small quantity
Coloring agent (Acid Blue #9): small quantity
Refined water: balance The content of the detergent composition in the present invention with respect to the total weight of the base material for forming the cleaning pad is preferably in the range of 1-30 wt %, or more preferably in the range of 3-8 wt %.

The detergent composition of the present invention is preferably contained in a dry state in the cleaning pad before use. By feeding water to the cleaning pad in the cleaning operation, said dry detergent composition is dissolved to form a liquid detergent composition that is held in the cleaning pad. The liquid detergent composition flows out of the pad when the cleaning pad rubs the object for cleaning in the cleaning operation. As a result, the cleaning effect can be improved.

According to the present invention, it is preferred that the detergent composition be contained at least in one layer of the two layers made of water degradable nonwoven fabric or water-soluble pulp paper. Also, the detergent composition may be contained in the entirety of the water degradable nonwoven fabric or water-soluble pulp paper as the outermost layers of the cleaning pad, or only in a portion of it.

Since the detergent composition is contained in the water degradable nonwoven fabric or water-soluble pulp paper as the outermost layer of the cleaning pad, when water is fed in the cleaning operation, the detergent composition is dissolved quickly, and the liquid detergent composition can make direct and continuous contact with the surface for cleaning, so that the cleaning effect can be further improved.

Also, the detergent composition in the present invention may be contained in the intermediate layer. In this case, the detergent composition may be contained in at least one of the two layers made of water degradable nonwoven fabric or water-soluble pulp paper and in the intermediate layer, or, it may be contained only in the intermediate layer. Also, the detergent composition may be contained homogeneously in the intermediate layer, or, it may be contained in a layered form.

The form of containment of the detergent composition in the cleaning pad of the present invention is not limited to the state of direct containment of the dry detergent composition in the base material of the cleaning pad. Other forms may also be adopted, such as the form in which the detergent composition is capsulated in micro-capsules for dispersion in the base material; the form in which the detergent composition is enclosed in water-soluble pouches; the form in which the detergent composition is gelled and contained; etc.

Abrasive

It is preferred that said detergent composition of the present invention also contain an abrasive in addition to said detergent composition. By containing an abrasive, it is possible to effectively remove dirt that cannot be removed by the liquid detergent alone. As a result, the cleaning property can be further improved.

As an abrasive for use in the present invention, one may use a conventional abrasive well known for removing dirt on the hard surface of a toilet or the like as the object for cleaning in the present invention. More specifically, it is preferred that at least one selected from the following group be used: alumina, zirconium oxide, tin oxide, cerium oxide, and diatomaceous earth. In consideration of hardness, safety, and cost, alumina is preferred. The average grain size of the abrasive is preferably in the range of 20-150 μm, or more preferably in the range of 40-60 μm.

There is no special limitation on the content of the abrasive in the cleaning pad of the present invention. The content of abrasive with respect to the total mass of the cleaning pad is preferably in the range of 1-20 wt %, or more preferably in the range of 3-8 wt %.

According to the present invention, it is especially preferred that the detergent composition and abrasive be contained in at least one layer of the two layers made of water degradable nonwoven fabric or water-soluble pulp paper. Also, it is preferred that the detergent composition and abrasive be contained in the intermediate layer. In this case, the detergent composition and abrasive may be contained in both at least one layer among the two layers made of water degradable nonwoven fabric or water-soluble pulp paper and the intermediate layer, or, they may be contained only in the intermediate layer.

From the viewpoint of the adherence between the water degradable nonwoven fabric or water-soluble pulp paper and the intermediate layer, it is preferred that the cleaning pad in the present invention contain a binder.

As far as the form for containing the binder is contained, one may adopt several forms, such as the form of containment in the interface between the water degradable nonwoven fabric or water-soluble pulp paper and the water-soluble pulp, the form of containment in the water degradable nonwoven fabric or water-soluble pulp paper, the form of containment in both the water degradable nonwoven fabric or water-soluble pulp paper and the intermediate layer, etc. For example, polyethylene or other well-known heat melting substances may be adopted. The content of the binder with respect to the total weight of the cleaning pad is preferably in the range of 2-20 wt %, or more preferably about 5 wt %.

Also, as long as the effect of the present invention is not reduced, the cleaning pad may also be contained in a core material. For example, a core material may be made of wire mesh (preferred for reinforcing the pad strength, the shape stability, etc.), a sand-like substance or other aggregate (preferred for removing large dirt cakes, etc.), water absorbing beads, etc. Selection is possible according to the specific purpose.

There is no special limitation on the shape of the cleaning pad of the present invention. One may adopt a rectangular parallelopiped shape, circular shape, elliptic shape, etc. The size of the cleaning pad can be selected appropriately corresponding to the application purpose.

For the cleaning pad of the present invention, it is preferred that it have one end held in a holder for use. The holder that can be preferably used in the present invention will be explained in more detail later with reference to the cleaning tool of the present invention.

When held with the holder, one may simply have one end of the cleaning pad held by the holder. Also, one may fold back the cleaning pad to form a portion for holding over a prescribed distance from the end of the pad in the length direction as the pad is folded back, and then have the portion for holding held by the holder. Here, FIGS. 2(*a*) and 2(*b*) are diagrams illustrating an example of the state as the cleaning pad is folded back for use.

Figure 2:
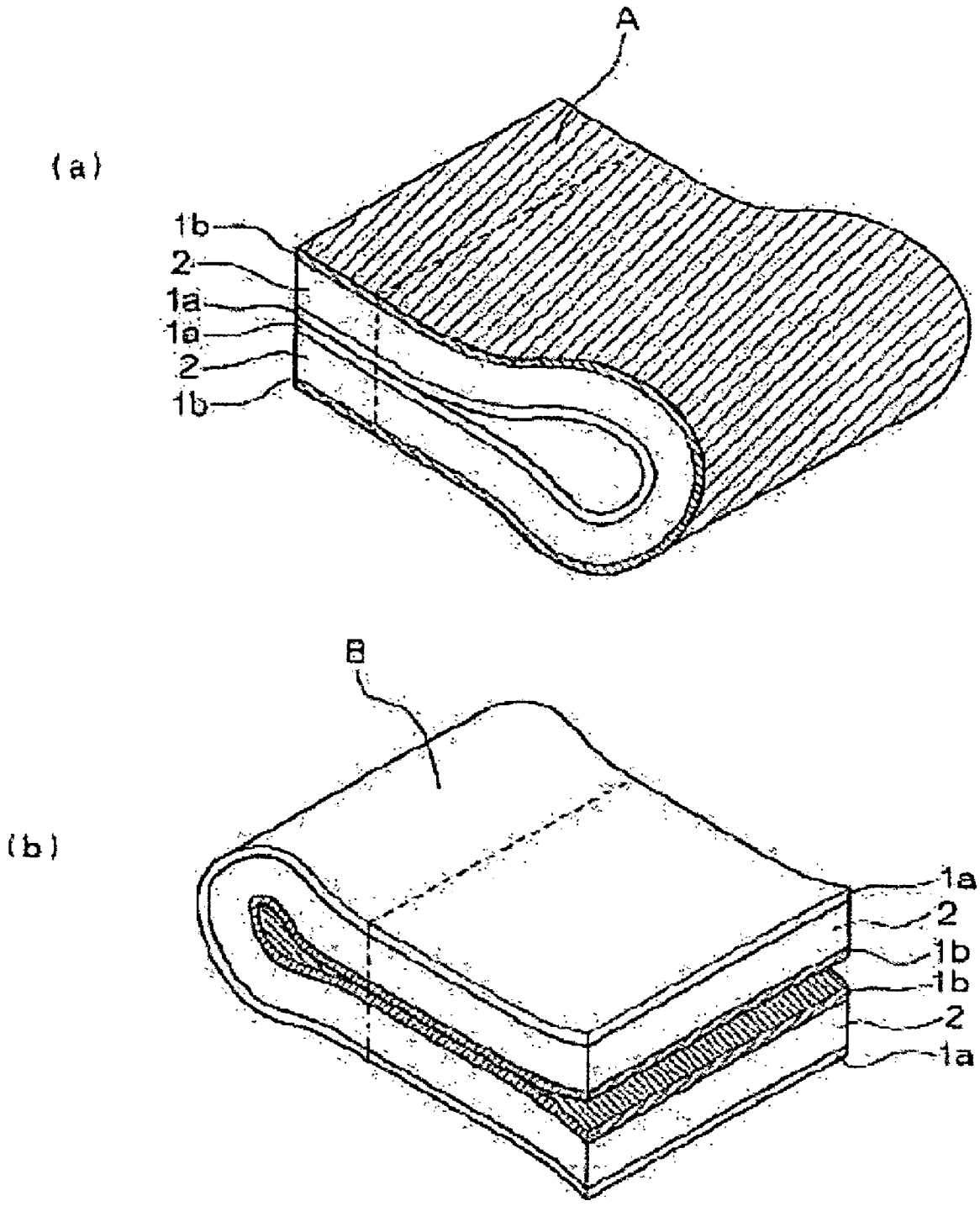
FIG. 2(*a*) is a diagram illustrating an example of the form of a cleaning pad folded for use.

In FIGS. 2(*a*) and 2(*b*), (1*a*) and (1*b*) represent the water degradable nonwoven fabric or water-soluble pulp paper; (2) represents the intermediate layer containing the water-soluble pulp. Also, in FIGS. 2(*a*) and 2(*b*), the hatched portion (1*b*) indicates the state of containment of the detergent composition (and abrasive) in the water degradable nonwoven fabric or water-soluble pulp paper. However, the present invention is not limited to this form.

A in FIG. 2(*a*) and B in FIG. 2(*b*) indicate the portion that forms the portion for holding of the pad in a folded-back state. For the form shown in FIG. 2(*a*), when portion A is held by the holder, a bulky state for the cleaning pad is possible as compared with the case when the cleaning pad is held in a flat pad shape as is, and it is thus possible to improve the pad strength and the durability of the cleaning effect. In the form shown in FIG. 2(*b*), when portion B is held by the holder and when used in a cleaning operation, the portion held by the holder is a base point when the cleaning pad is opened in a V-shape for use. As a result, the contact area of the pad with respect to the surface for cleaning is increased, and the motion of the pad in the cleaning operation is diverse, so that the operability and cleaning effect of the pad can be further improved.

Method for Manufacturing the Cleaning Pad

For example, the cleaning pad of the present invention may be manufactured as follows: Water degradable pulp is fed between two continuous water degradable nonwoven fabric sheets or water-soluble pulp paper, followed by pressing for bonding and then cutting to any desired size. The detergent composition contained in the cleaning pad may be attached at any stage during the manufacturing process of the cleaning pad.

Laminated Body of Cleaning Pads

The laminated body of cleaning pads of the present invention is characterized by the fact that it is prepared by laminating two or more cleaning pads of the present invention. By forming a laminated body of cleaning pads, it is possible to obtain various forms of motion of the pads in cleaning, and, compared with the case when a single cleaning pad is used, it is possible to improve the cleaning effect. There is no special limitation on the number of pads that can be laminated for the laminated body of cleaning pads. However, as to be explained in the following, it is preferred that two or three pads be laminated to form a laminated body of cleaning pads.

A preferable form of the laminated body of cleaning pads is a laminated body of cleaning pads prepared from two cleaning pads of the present invention.

For the laminated body of cleaning pads prepared from two cleaning pads, the following form is preferred: two pads, each of which is prepared by containing detergent and abrasive in one layer among the two layers made of water degradable nonwoven fabric or water-soluble pulp paper and by sandwiching an intermediate layer containing water degradable pulp between the two layers made of water degradable nonwoven fabric or water-soluble pulp paper, are laminated with their surfaces containing said detergent and abrasive facing each other.

Figure 3:
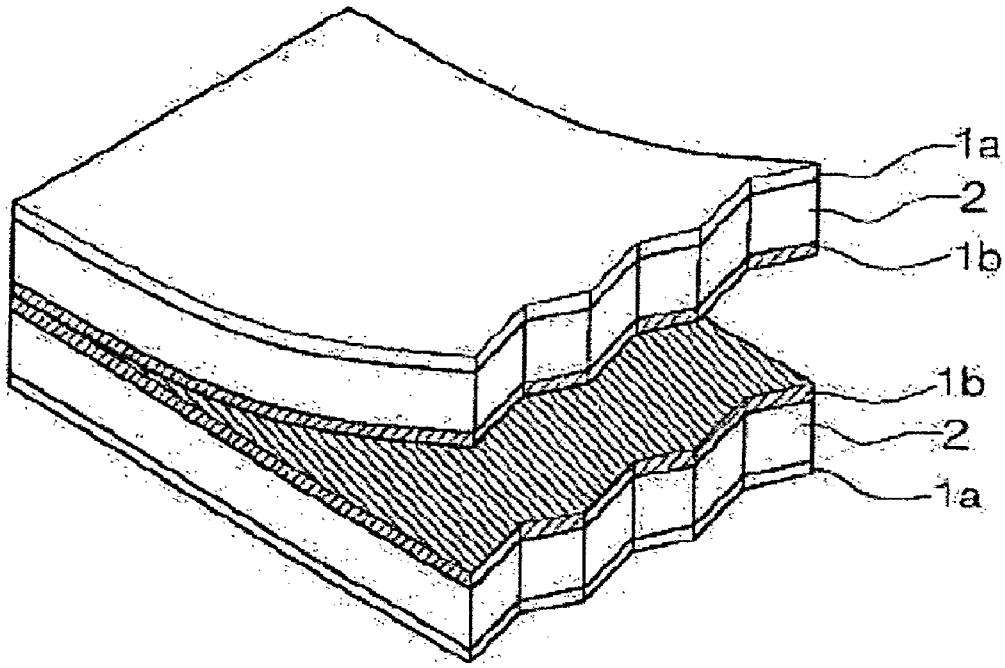
FIG. 3 is a diagram illustrating an embodiment of a laminated body of cleaning pads of the present invention.

FIG. 3 is a diagram illustrating an example of a laminate prepared by laminating two cleaning pads of the present invention. In FIG. 3, (1*a*) and (1*b*) illustrate water degradable nonwoven fabric or water-soluble pulp paper; (2) represents the intermediate layer containing the water-soluble pulp. In FIG. 3, the hatched portion (1*b*) in the cleaning pad as a 2-layer laminate is the portion that contains the detergent composition and abrasive.

In this form, two cleaning pads of said type are laminated. When a cleaning operation is performed, the two pads are opened to a V-shape with the portion held by the holder as the base point, the contact area with respect to the surface for cleaning is increased, and, at the same time, the motion of the pad is diverse. In addition, since the water degradable nonwoven fabric or water-soluble pulp paper that forms the inner surfaces opened in a V-shape contains detergent and abrasive, when water is fed to the cleaning pad, the detergent composition is quickly dissolved, so that the liquid detergent composition is directly and continuously applied to the surface for cleaning. Consequently, compared with a single cleaning pad, the cleaning effect can be further improved.

As the best form of the laminated body of cleaning pads of the present invention, another cleaning pad is sandwiched between the two pads that form said laminated body (the laminated body of the present invention) prepared by laminating two cleaning pads. Here, said another cleaning pad may be of the same type as the cleaning pad of the present invention (in the form containing a detergent composition), or free of the detergent composition while having the same layer configuration as the cleaning pad of the present invention. It may also be another pad made of a water degradable or water-soluble raw material. From the viewpoint of manufacturing cost, it is preferred that the same layer configuration as the cleaning pad of the present invention be used as said another cleaning pad.

When another pad is sandwiched between the two pads to form a laminate and the laminate is in use, the intermediate pad (the another pad) disintegrates, so the spacing between the two outer pads (the V-shaped spacing) increases. As a result, it is possible to prevent the water-impregnated pads that form the laminate from sticking to each other, and it is possible to improve the cleaning operability.

Figure 4:
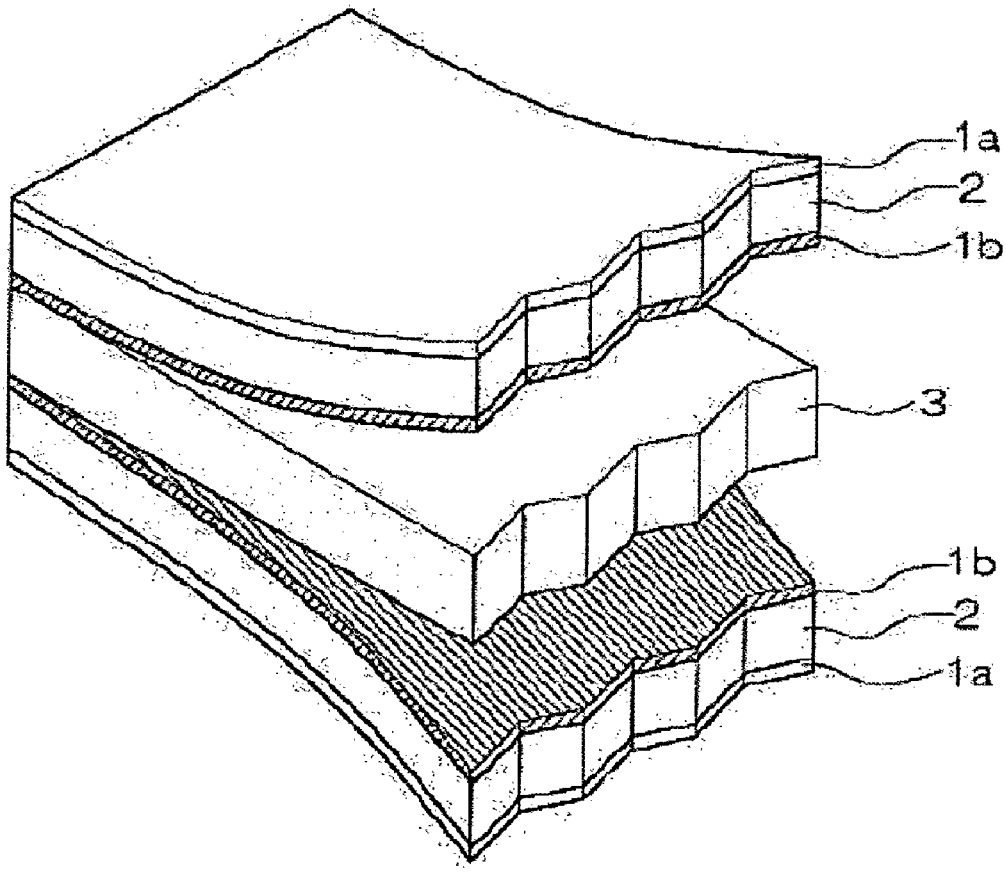
FIG. 4 is a diagram illustrating another embodiment of a laminated body of cleaning pads of the present invention.

FIG. 4 is a diagram illustrating an example of a laminated body of cleaning pads of this embodiment. In FIG. 4, (1*a*) and (1*b*) represent the water degradable nonwoven fabric or water-soluble pulp paper, (2) represents the intermediate layer containing water-soluble pulp, and (3) represents said another pad. In FIG. 4, hatched portion (1*b*) indicates containment of the detergent composition and abrasive.

Cleaning Tool

The cleaning pad or laminated body of cleaning pads of the present invention is held on a holder to form a cleaning tool. That is, the cleaning tool of the present invention is characterized by the fact that it is composed of a cleaning pad of the present invention and a holder that holds the pad. Also, as another form, the cleaning tool of the present invention is composed of a laminated body of cleaning pads of the present invention and a holder that holds said [laminated body of] cleaning pads.

There is no special limitation on the form of holding by the holder, as long as the cleaning pad or laminated body of cleaning pads can be held during the cleaning operation. It is preferred that the cleaning pad or laminated body of cleaning pads be clamped and held.

In the following, an explanation will be provided for the cleaning tool of the present invention with reference to figures. However, the present invention is not limited to the example.

Figure 5:
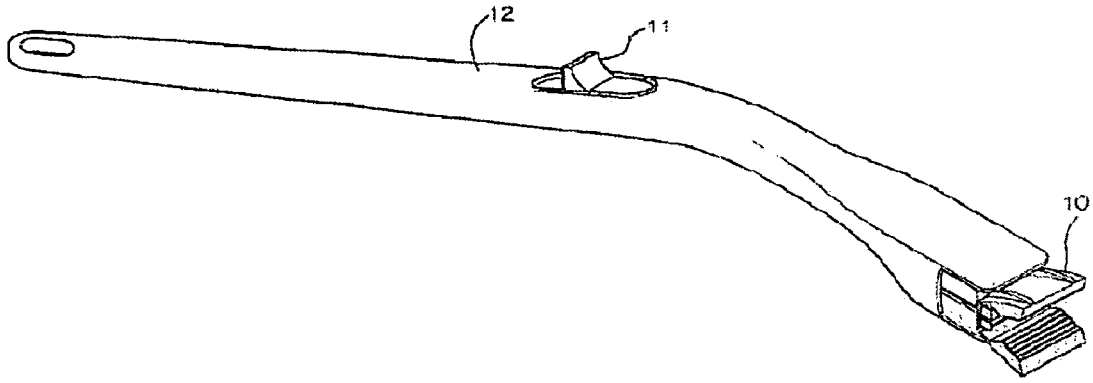
FIG. 5 is a diagram illustrating an example of a holder in the cleaning tool of the present invention (in a state with the holding part open).
Figure 6:
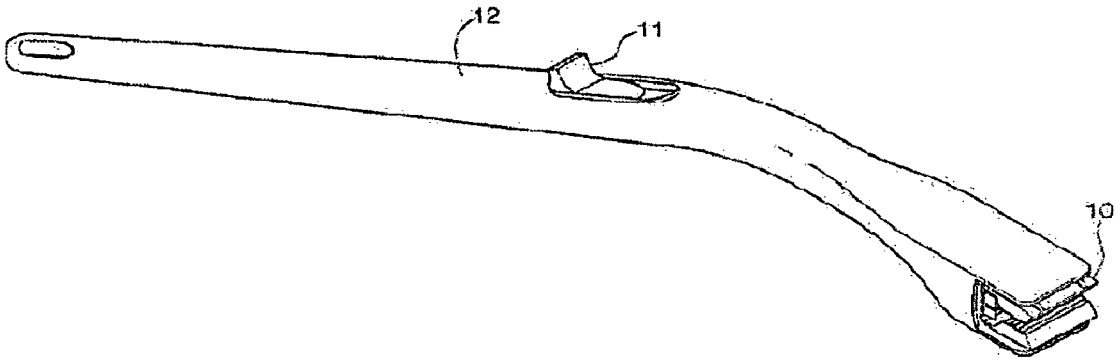
FIG. 6 is a diagram illustrating an example of a holder in the cleaning tool of the present invention (in a state with the holding part closed).

FIGS. 5 and 6 illustrate a form of the holder that can be used for the cleaning tool of the present invention. In FIGS. 5 and 6, the holder of the present invention is composed of holding part (10), manipulating part (11), and cleaning tool main body (12).

Holding part (10) is the member that holds the cleaning pad or laminated body of the cleaning pads of the present invention. Holding part (10) is connected to manipulating part (11) through the interior of hollow main body (12) of the cleaning tool. As shown in FIG. 5, if manipulating part (11) is slid toward holding part (10), holding part (10) is opened outside main body (12) of the cleaning tool. In said opened holding part (10), the cleaning pad or laminated body of cleaning pads (not shown in the figure) is held. When manipulating part (11) is slid in the direction opposite holding part (10), as shown in FIG. 6, holding part (10) is accommodated inside main body (12) of the cleaning tool, and the cleaning pad or laminated body of cleaning pads (13) is held. After the completion of cleaning, manipulating part (11) is slid in the direction of holding part (10), and the used cleaning pad or laminated body of cleaning pads can be removed easily.

Figure 7:
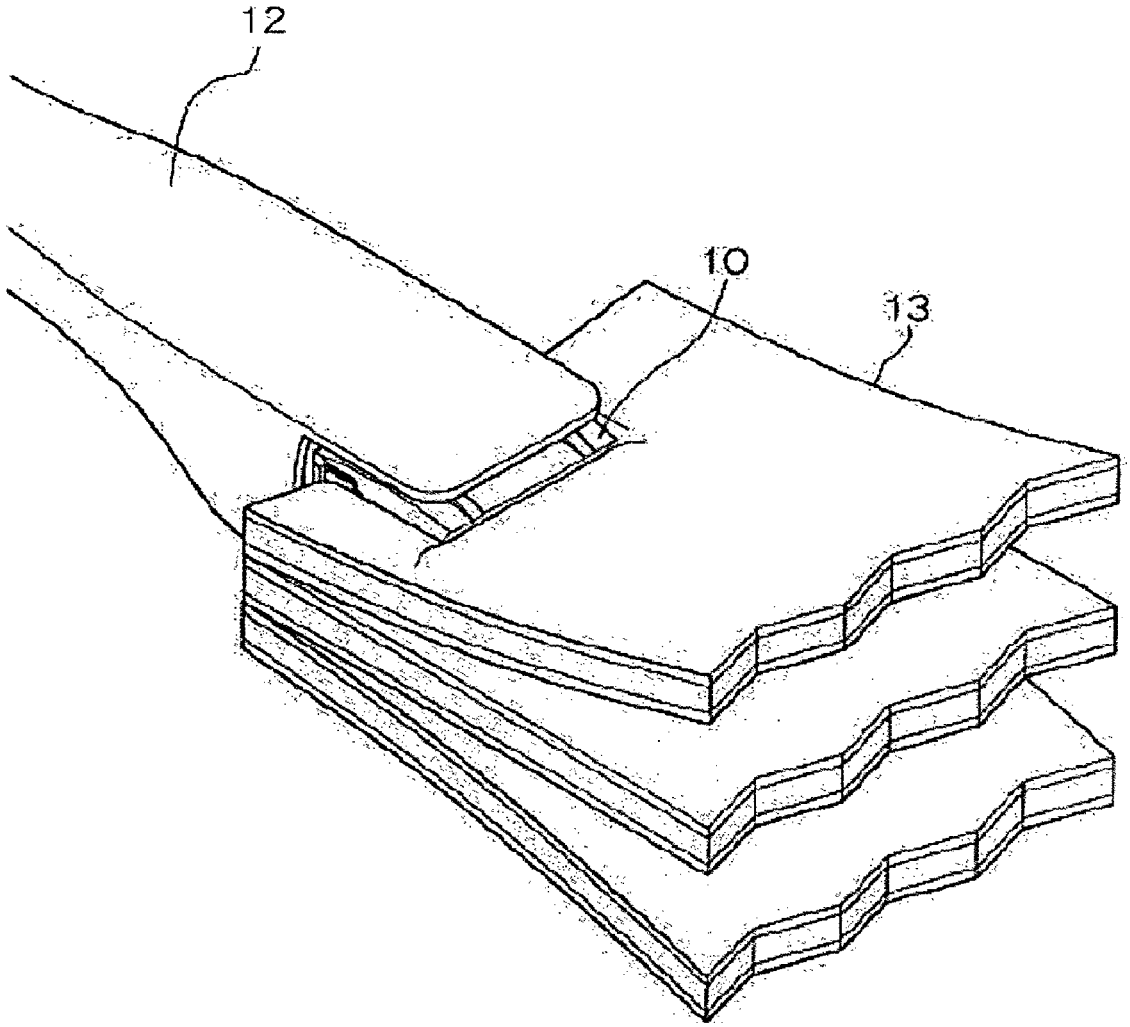
FIG. 7 is an enlarged partial view illustrating a state of holding of a laminated body of cleaning pads with a holder in the cleaning tool of the present invention.

FIG. 7 is an enlarged view illustrating the state in which a laminated body of the present invention is held by holding part (10).

For the holder in the cleaning tool of the present invention with the aforementioned constitution, it is possible to easily hold the cleaning pad or the laminated body of cleaning pads on the holder, and the cleaning pad or liquid mold injected elastomer material after use can be disposed of easily without the need to touch it with one's hands. This is preferred from the viewpoint of hygiene.

As explained above, the cleaning pad or laminated body of cleaning pads of the present invention has a water-resolving property. Consequently, when it is used in cleaning a toilet, the used cleaning pad can be disposed of directly in the toilet and flushed.

We claim:

1. A laminated body of cleaning pads comprising two or more cleaning pads laminated at an end of the body together, wherein at least one of the cleaning pads comprises an intermediate layer comprising water-degradable pulp interposed between two more outer layers of water-degradable nonwoven fabric, the intermediate layer and at least one more outer layer being formed of different materials, and the laminated body is to be held at said end by a holder with the pads at another end of the body being opened from each other to form a V-shape along a lateral side of the body and thereby increase available pad contact surface area.

2. The laminated body of claim 1, further comprising a cleaning composition and/or an abrasive positioned on a layer.

3. The laminated body of claim 2, wherein abrasive is positioned on a layer and is selected from the group consisting of alumina, zirconium oxide, cerium oxide, and diatomaceous earth.

4. The laminated body of claim 2, wherein cleaning composition is positioned on a layer and is included in the intermediate layer.

5. The laminated body of claim 2, wherein abrasive is positioned in the intermediate layer.

6. The laminated body of claim 1, wherein the water degradable nonwoven fabric is a spunless nonwoven fabric.

7. A laminated body of cleaning pads comprising three cleaning pads laminated at an end of the body together, wherein at least two of the cleaning pads comprises an intermediate layer comprising water-degradable pulp interposed between two more outer layers of water-degradable nonwoven fabric, the intermediate layer and at least one more outer layer being formed of different materials, and the laminated body is to be held at said end by a holder with the pads at another end of the body being opened from each other to form two V-shapes along a lateral side of the body and thereby increase available pad contact surface area.

* * * * *